US012385489B2

(12) United States Patent
Miller et al.

(10) Patent No.: US 12,385,489 B2
(45) Date of Patent: Aug. 12, 2025

(54) VACUUM PUMP

(71) Applicant: MILWAUKEE ELECTRIC TOOL CORPORATION, Brookfield, WI (US)

(72) Inventors: Justin D. Miller, Richfield, WI (US); Shrey M. Turakhiya, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 53 days.

(21) Appl. No.: 18/131,083

(22) Filed: Apr. 5, 2023

(65) Prior Publication Data

US 2023/0313803 A1 Oct. 5, 2023

Related U.S. Application Data

(60) Provisional application No. 63/476,240, filed on Dec. 20, 2022, provisional application No. 63/327,599, filed on Apr. 5, 2022.

(51) Int. Cl.
*F04C 27/00* (2006.01)
*F04C 18/344* (2006.01)
(Continued)

(52) U.S. Cl.
CPC ..... *F04C 27/003* (2013.01); *F04C 23/001* (2013.01); *F04C 25/02* (2013.01); *F04C 27/002* (2013.01); *F04C 18/3441* (2013.01)

(58) Field of Classification Search
CPC ..... F04C 27/003; F04C 23/001; F04C 25/02; F04C 27/002; F04C 2/344; F04C 18/344; F04C 18/3441; F04C 27/001
See application file for complete search history.

(56) References Cited

U.S. PATENT DOCUMENTS 3,841,044 A * 10/1974 Brown ..... B60R 19/44 52/716.5
4,123,201 A * 10/1978 Andriulis ..... F04C 27/02 464/147

(Continued)

FOREIGN PATENT DOCUMENTS

JP S5885388 * 5/1983 ..... F04C 27/001
JP 2018178874 * 11/2018 ..... Y02E 60/10

OTHER PUBLICATIONS

JP2018178874 translation (Year: 2024).*
JPS5885388 translation (Year: 2024).*

*Primary Examiner* — David N Brandt
(74) *Attorney, Agent, or Firm* — Michael Best & Friedrich LLP

(57) ABSTRACT

A vacuum pump, which is connectable to an external system and configured to evacuate material from the external system, includes a main housing defining a motor housing, a pump housing, and a partition wall that separates the motor housing and the pump housing. The pump housing is sealed relative to the motor housing to form a compression chamber that holds a lubrication fluid. The vacuum pump further includes a motor assembly that is positioned within the motor housing and a pump assembly that is positioned within the compression chamber. The pump assembly is driven by the motor assembly and is in fluid communication with the compression chamber. The pump assembly includes a pump chamber, a rotor having vanes that is driven within the pump chamber, and a seal that is in sliding contact with the rotor. The seal is moveable relative to the rotor.

5 Claims, 8 Drawing Sheets

(51) Int. Cl.
*F04C 23/00* (2006.01)
*F04C 25/02* (2006.01)

(56) References Cited

U.S. PATENT DOCUMENTS 4,283,167 A * 8/1981 Bassan ..... F04C 29/04
418/101
5,145,335 A * 9/1992 Abelen ..... F04B 39/066
417/410.3
5,156,532 A * 10/1992 Arndt ..... F04C 25/02
277/563
5,209,653 A * 5/1993 Murray ..... F04C 28/28
417/435
5,853,201 A * 12/1998 Izumi ..... B60H 1/00571
285/179
6,063,475 A * 5/2000 Ciancio ..... B32B 27/304
428/212

* cited by examiner

VACUUM PUMP

CROSS-REFERENCE TO RELATED APPLICATIONS

This application claims priority to U.S. Provisional Patent Application No. 63/476,240, filed on Dec. 20, 2022, and U.S. Provisional Patent Application No. 63/327,599, filed on Apr. 5, 2022, the entire contents of both of which are incorporated by reference herein.

FIELD OF THE INVENTION

The present invention relates to a pump, and more particularly to a vacuum pump.

BACKGROUND OF THE INVENTION

Vacuum pumps may be used to remove or evacuate material such as unwanted air, gas, and non-condensables (e.g., water vapor), from an external system (e.g., an air conditioning system, a refrigeration system, etc.). Vacuum pumps may be used to evacuate the external system before the system is charged with refrigerant or when the existing system is undergoing repair (e.g., the refrigerant is already recovered). The vacuum pump may be connected to high- and low-pressure sides of the external system via hoses and a manifold. During operation, the vacuum pump creates a low-pressure zone that draws the unwanted materials such as air and non-condensables out of the external system, which has a high pressure, and into the vacuum pump.

SUMMARY OF THE INVENTION

The present disclosure provides, in one aspect, a vacuum pump that is connectable to an external system and configured to evacuate material from the external system. The vacuum pump includes a main housing defining a motor housing, a pump housing, and a partition wall that separates the motor housing and the pump housing. The pump housing is sealed relative to the motor housing to form a compression chamber that holds a lubrication fluid. The vacuum pump further includes a motor assembly that is positioned within the motor housing of the main housing, a battery that is coupled to the main housing and configured to supply electrical current to the motor assembly, and a pump assembly that is positioned within the compression chamber. The pump assembly is driven by the motor assembly and is in fluid communication with the compression chamber. The pump assembly includes a pump chamber, a rotor having vanes that is driven within the pump chamber, and a seal that is in sliding contact with the rotor. The seal is moveable relative to the rotor.

The present disclosure provides, in another aspect, a vacuum pump that is connectable to an external system and configured to evacuate material from the external system. The vacuum pump includes a motor assembly that is positioned within a motor housing, a battery that is coupled to the motor housing and configured to supply electrical current to the motor assembly, and a pump assembly that is positioned within a pump housing. The pump housing is sealed relative to the motor housing to form a compression chamber storing a lubrication fluid. The pump assembly is driven by the motor assembly and is in fluid communication with the compression chamber. The vacuum pump further includes a trestle that separates the motor housing and the pump housing, and an inlet manifold coupled to the trestle that fluidly connects the pump assembly to the external system. The vacuum pump further includes a bumper composed of an elastomeric material and coupled to the trestle to protect the vacuum pump from damage when inadvertently dropped.

Other features and aspects of the invention will become apparent by consideration of the following detailed description and accompanying drawings.

Figure 1:
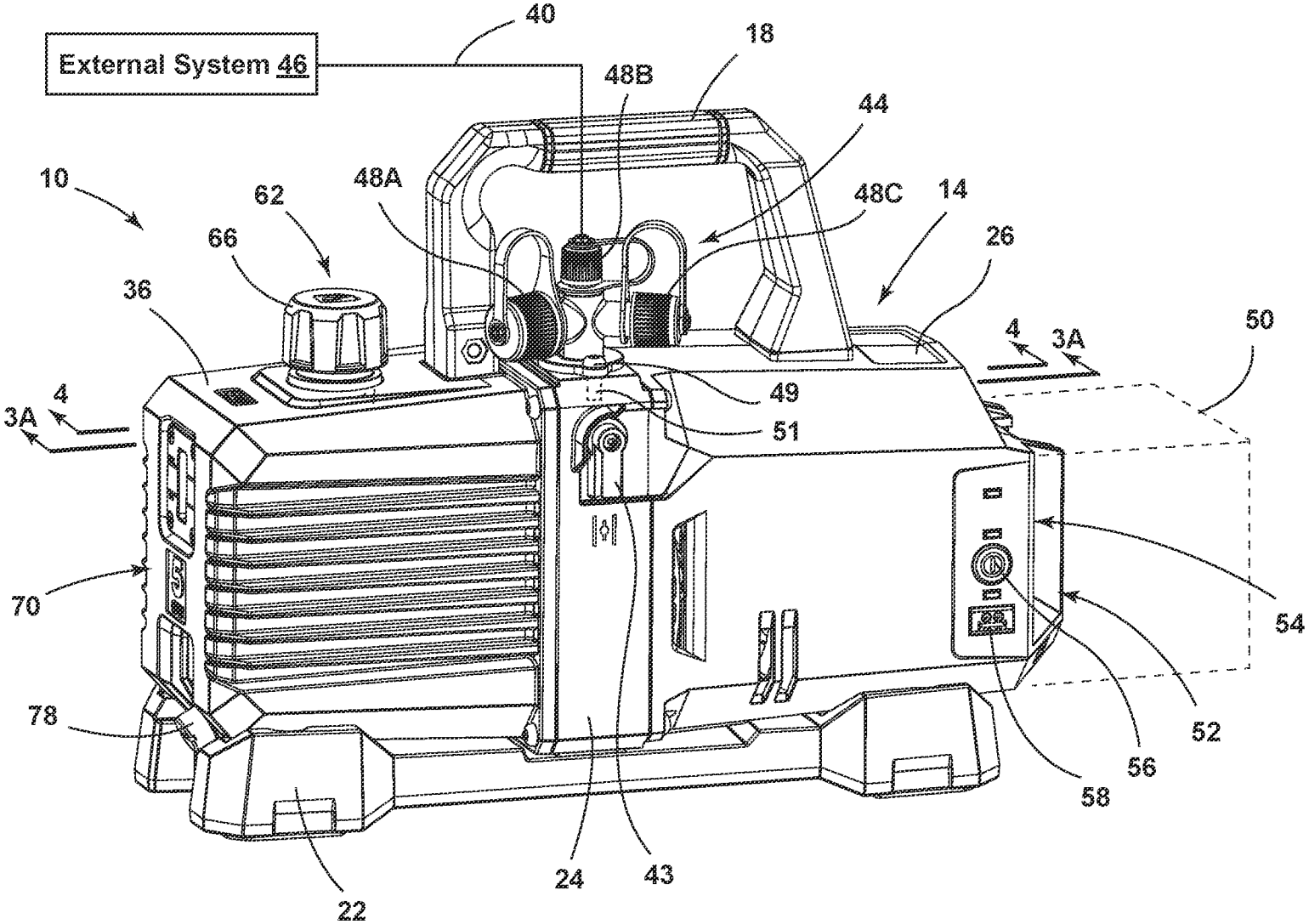
FIG. 1 is a left perspective view of a vacuum pump according to an embodiment of the invention.

Before any embodiments of the present subject matter are explained in detail, it is to be understood that the present subject matter is not limited in its application to the details of construction and the arrangement of components set forth in the following description or illustrated in the following drawings. The present subject matter is capable of other embodiments and of being practiced or of being carried out in various ways.

DETAILED DESCRIPTION

FIGS. 1-4 illustrate a vacuum pump 10 including a housing 14, a handle 18 coupled to an upper portion of the housing 14, and a base 22 coupled to a lower portion of the housing 14 to support the vacuum pump 10 relative to a support surface. The housing 14 includes (FIG. 3A) a trestle 24, a motor housing 26 that houses, protects, and/or conceals a motor assembly 30, an electronic control unit 34, and other electronic components. The housing 14 further includes a pump housing 36 that houses a pump assembly 42 within a compression chamber 38. The trestle 24 is disposed between the motor housing 26 and the pump housing 36.

With continued reference to FIGS. 1-4, an inlet manifold 44 is positioned on an upper portion of the trestle 24 and is in communication with the pump assembly 42 via a valve switch 43 (FIG. 1). The inlet manifold 44 is fluidly connected to a hose 40 that connects the vacuum pump 10 to an external system 46 (e.g., an air conditioning system, a refrigeration system, etc.). In the illustrated embodiment, the inlet manifold 44 includes multiple connection ports 48*a*, 48*b*, 48*c* that are sized to connect to the hose 40 of the external system 46. For example, the connection ports 48*a*, 48*b*, 48*c* may have various sizes (e.g., ½ inch, ⅜ inch, ¼ inch, etc. In the illustrated embodiment, of FIG. 1 and 3C, the inlet manifold 44 is a flange-style manifold that removes the need for thread locking and thread sealant. Instead, the inlet manifold 44 of FIG. 3C includes a flange 45 with an O-ring (not shown), providing a watertight connection between the inlet manifold 44 and the trestle 24 which allows for ease of assembly and servicing of the compression chamber 38. Specifically, the O-ring is disposed on an outer periphery of the flange 45 such that the inlet manifold 44 is in sealed fluid communication with the pump assembly 42. The inlet manifold 44 is fastened to the trestle 24 using a plurality of threaded fasteners 49 (FIG. 1) received within corresponding threaded bores 51 within the trestle 24.

A battery pack 50 is removably coupled to an end portion of the housing 14 via a battery receptacle 52. The battery pack 50 provides electrical current to the motor assembly 30 that drives the pump assembly 42 to remove or evacuate material such as air, gas, and non-condensables (e.g., water vapor) from the external system 46. The vacuum pump 10 includes a control panel 54 on one sidewall of the housing 14 and a bumper 55 (FIG. 2A) on an opposite sidewall of the housing 14. In the illustrated embodiment, the control panel 54 is disposed on the motor housing 26 and includes a power switch 56 that selectively activates the vacuum pump 10 and a Universal Serial Bus (USB) port 58. In some embodiments, an external display may be connected to the USB port 58 to display information related to the operation of the vacuum pump 10 (e.g., battery life remaining, micron gauge, etc.). In other embodiments, the control panel 54 may include a display (e.g., an LCD display). The bumper 55 is composed of an elastomeric material (e.g., rubber) and is intended to protect the pump 10 from damage when inadvertently dropped or tipped from the upright orientation shown in FIG. 2A. As shown in FIG. 2B, the bumper 55 is coupled to the trestle 24 and includes a pair of T-ribs 57 that are received within a pair of corresponding slots 59 of the trestle 24. In other words, the T-ribs 57 retain the bumper 55 to the trestle 24. As shown in FIG. 2C, the bumper 55 also includes a concave face 61 from which the T-ribs 57 project. The concave face 61 bends or deforms when laid flat (i.e., flush) against the housing 14 as the T-ribs 57 are received in the slots 59.

Figure 3A:
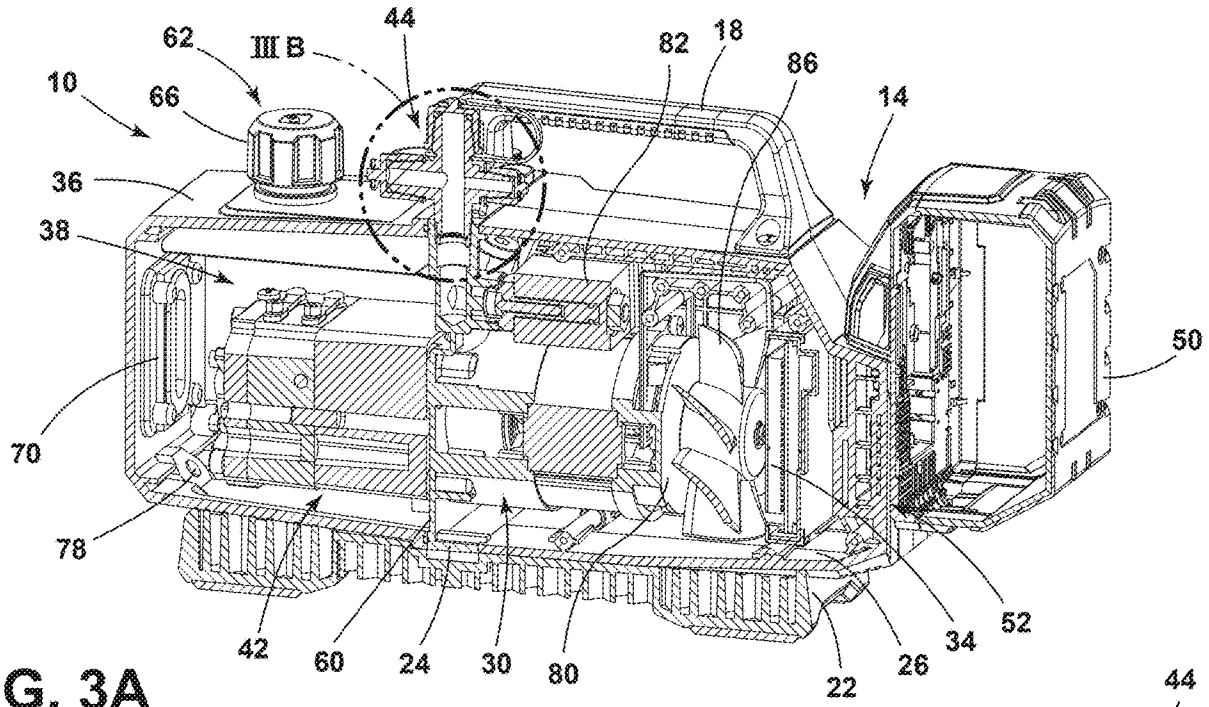
FIG. 3A is a cross-sectional perspective view of the vacuum pump along line 3A-3A of FIG. 1.
Figure 3C:
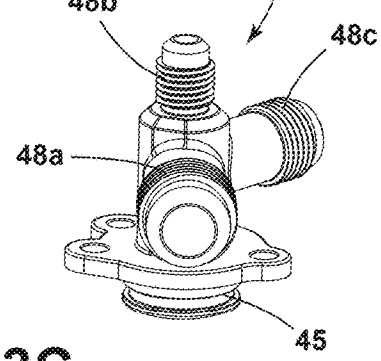
FIG. 3C is a perspective view of the inlet manifold of FIG. 3B.
Figure 3B:
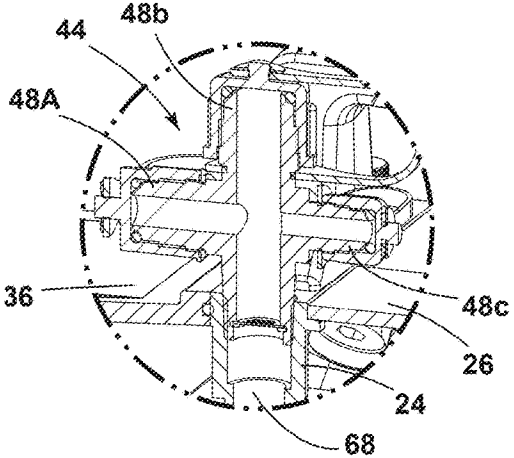
FIG. 3B is an enlarged view of an inlet manifold of the vacuum pump.

With reference to FIG. 3A, the compression chamber 38 is sealed relative to the motor housing 26 via the trestle 24 so the compression chamber 38 can hold lubrication fluid (e.g., oil). Specifically, the trestle 24 includes a partition wall 60 that seals the compression chamber 38 from the motor housing 26. The trestle 24 defines a fluid pathway 68 that extends between the inlet manifold 44 and the pump assembly 42. The lubrication fluid positioned within the compression chamber 38 is used to lubricate and cool the pump assembly 42 during operation of the vacuum pump 10.

Figure 2A:
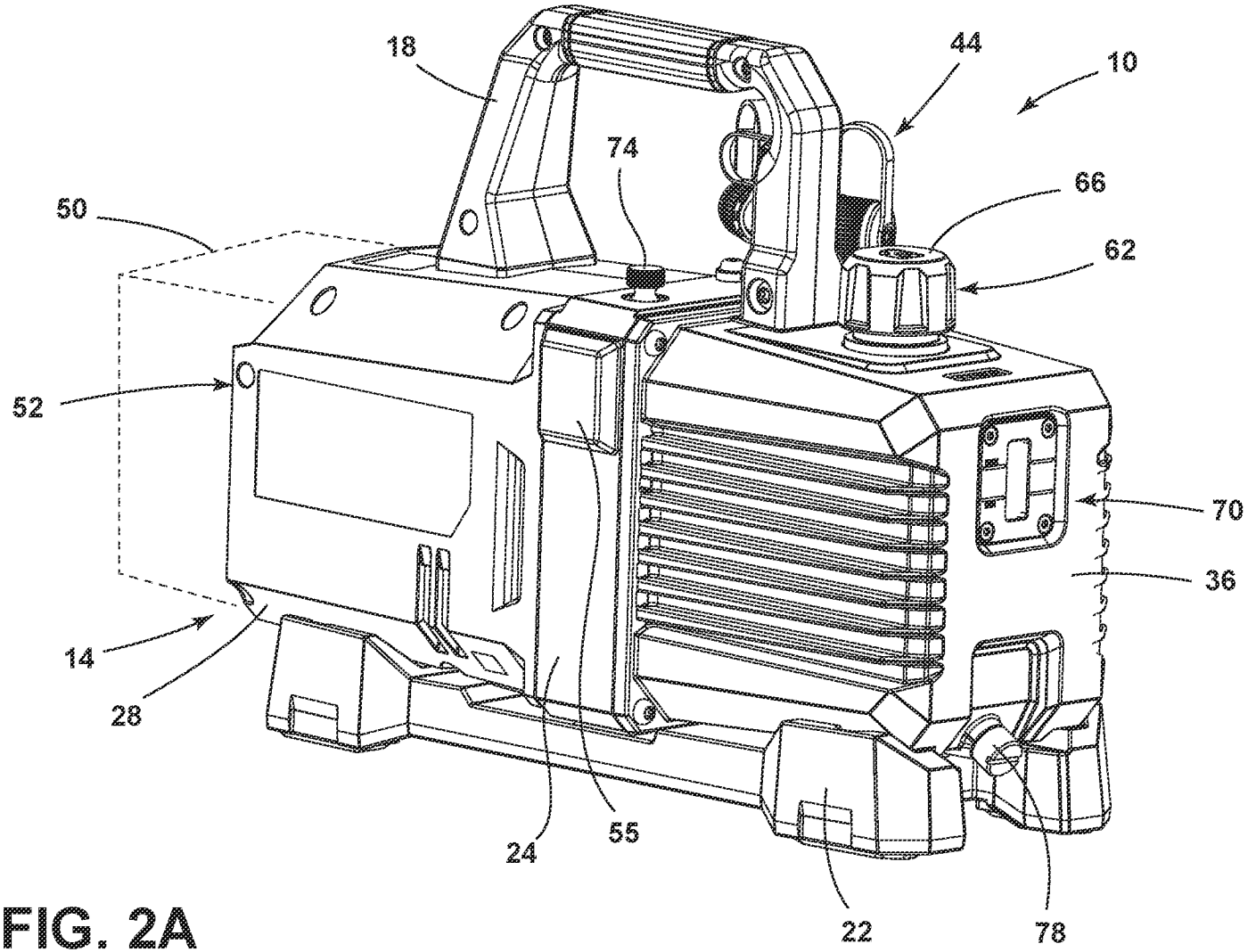
FIG. 2A is a right perspective view of the vacuum pump of FIG. 1.
Figure 2C:
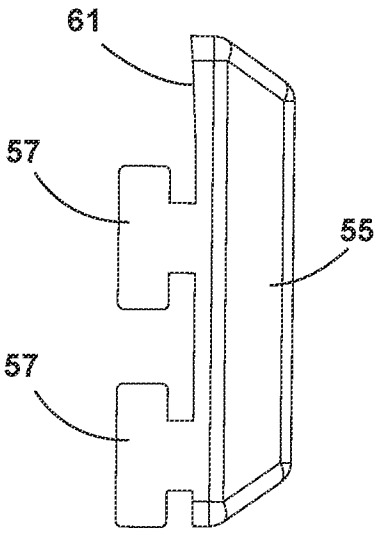
FIG. 2C is a side view of the bumper of FIG. 2B removed from the housing of the vacuum pump.
Figure 2B:
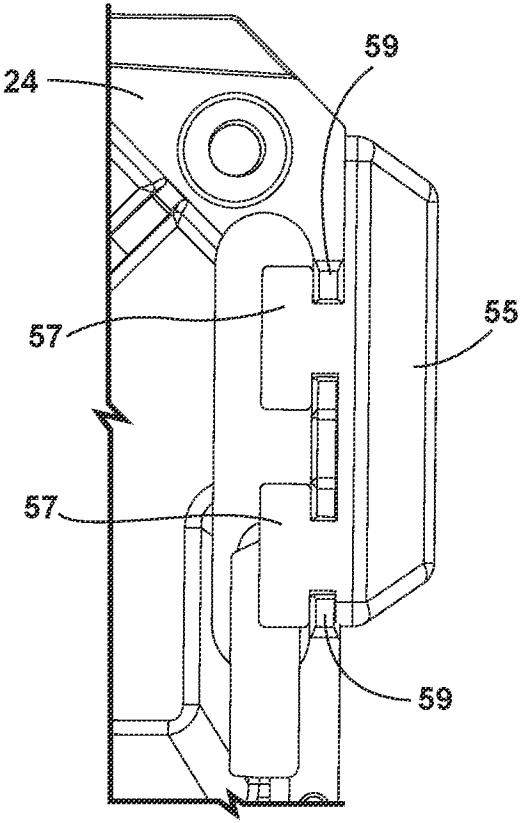
FIG. 2B is a cross-sectional view along line FIG. 2B-2B of FIG. 2A, illustrating a bumper attached to a housing of the vacuum pump.

With reference to FIGS. 2A and 3A, the compression chamber 38 further includes a fluid port 62 having a removable cap 66, a fluid gauge 70 positioned on a sidewall of the pump housing 36, a release valve 74 positioned on the upper portion of the trestle 24, and a fluid drain valve 78 positioned at the bottom of the compression chamber 38 adjacent the base 22. In the illustrated embodiment, a user may remove the removable cap 66 to fill the compression chamber 38 with lubrication fluid via the fluid port 62. The fluid port 62 and the removable cap 66 may also function as an exhaust during operation of the vacuum pump 10. The fluid gauge 70 may be transparent to allow a user to determine the amount of lubrication fluid that is held within the compression chamber 38. Also, the fluid drain valve 78 allows the user to drain the lubrication fluid from the compression chamber 38.

Figure 4:
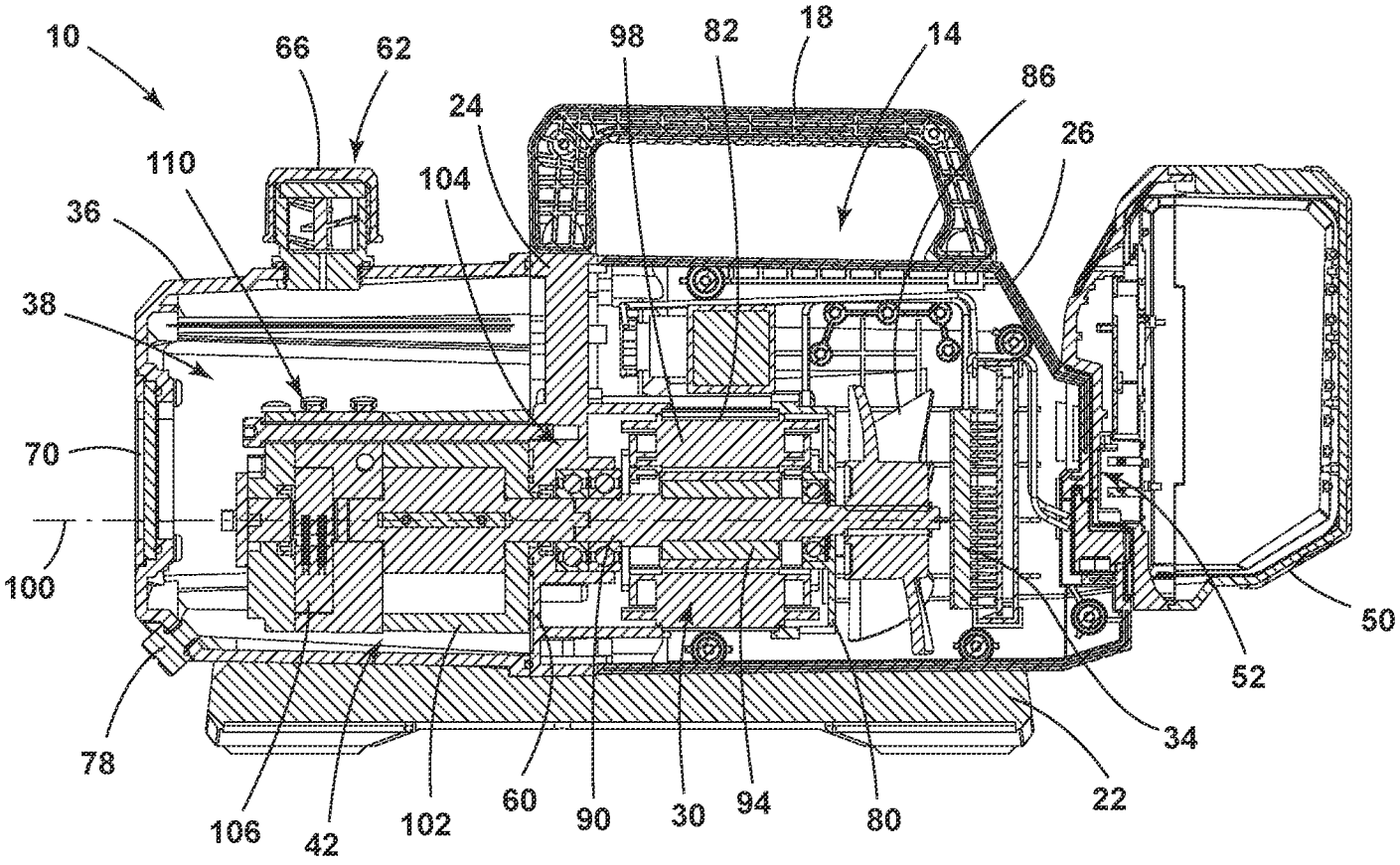
FIG. 4 is a cross-sectional plan view of the vacuum pump along line 4-4 of FIG. 1.

With reference to FIG. 4, the motor assembly 30 is positioned within the motor housing 28 and is coupled to the partition wall 60 of the trestle 24 via a support bracket 80. The motor assembly 30 includes a motor 82 and a fan 86 driven by the motor 82. In the illustrated embodiment, the motor 82 is a brushless direct current (BLDC) motor that has a motor shaft 90 having a first end coupled to the fan 86 and a second end coupled to the pump assembly 42, a rotor 94 coupled to the motor shaft 90, and a stator 98 surrounding the rotor 94. During operation of the motor 82, an electrical current flows through coils of the stator 98 to produce a magnetic field around the rotor 94, causing the rotor 94 and the motor shaft 90 to rotate about a drive axis 100 and drive the pump assembly 42. The fan 86 is positioned between the electronic control unit 34 and the motor assembly 30. The fan 86 removes heat from the electronic control unit 34 and provides air to the motor assembly 30 to prevent overheating of each of the electronic control unit 34 and the motor assembly 30. Although the motor 82 of the illustrated embodiment is a BLDC motor, in other embodiments, the motor 82 may alternatively be a brushed direct current motor or any other type of DC motor.

Figure 5:
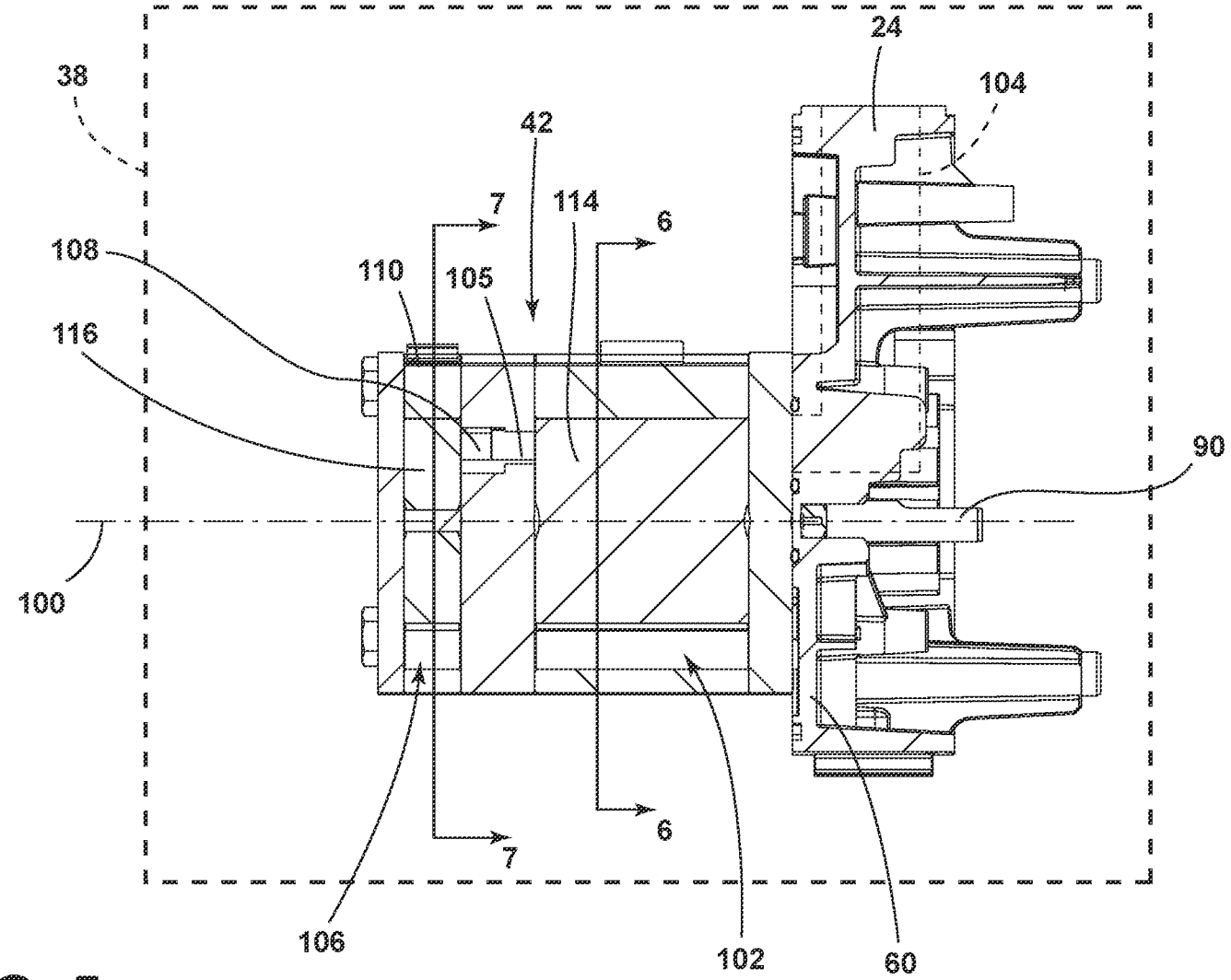
FIG. 5 is an enlarged cross-sectional view of FIG. 4, illustrating a pump assembly that is disposed within the vacuum pump.

With reference to FIGS. 4 and 5, the pump assembly 42 is a two-stage pump that has a first pump chamber 102 and a second pump chamber 106 in series with the first pump chamber 102. The first pump chamber 102 has a first pump inlet 104 in communication with the fluid pathway 68 and a first pump outlet 105 that is in fluid communication with a second pump inlet 108 of the second pump chamber 106. The second pump chamber 106 has a second pump outlet 110 that releases the pressure from the pump assembly 42 to the compression chamber 38. Although the illustrated pump assembly 42 is a two-stage pump (e.g., has first and second pump chambers), in other embodiments, the pump assembly 42 may only include a single stage or chamber.

Figure 7:
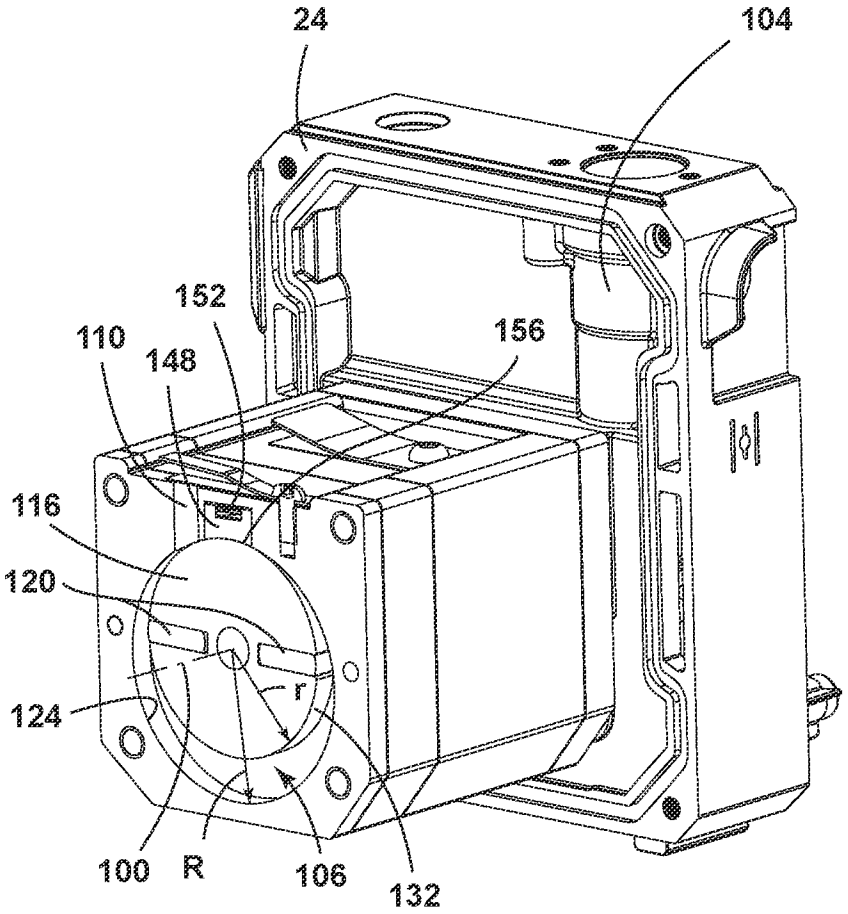
FIG. 7 is a cross-sectional perspective view of the pump assembly along line 7-7 of FIG. 5, illustrating a second spring-loaded seal disposed adjacent a second pump chamber.
Figure 6:
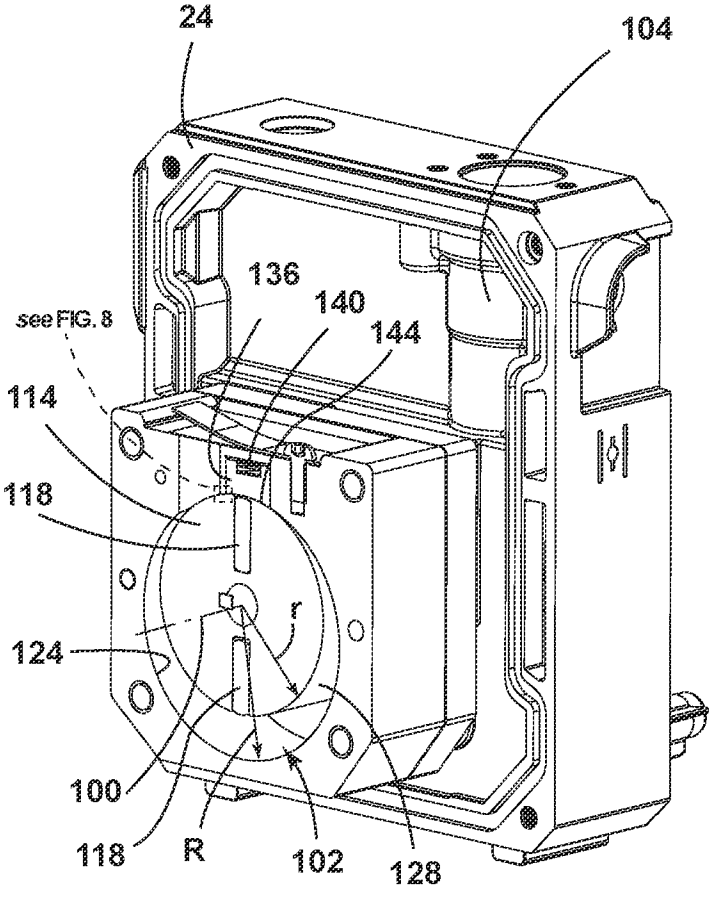
FIG. 6 is a cross-sectional perspective view of the pump assembly along line 6-6 of FIG. 5, illustrating a first spring-loaded seal disposed adjacent a first pump chamber.

With reference to FIGS. 6 and 7, the first pump chamber 102 includes a first rotor 114 and the second pump chambers 106 includes a second rotor 116. The first and second rotors 114, 116 each include a pair of vanes 118, 120 that are biased outward toward an interior surface 124 of the pump chambers 102, 106 (FIGS. 6 and 7) via centrifugal forces. In other embodiments, the vanes 118, 120 may be biased outward via springs or some other biasing member. As a result, the rotation of the eccentrically mounted rotors 114, 116 create low-pressure zones within the pump assembly 42, which draws material out of the external system 46 (FIG. 1) and into the pump assembly 42. The evacuated material is transferred from the first pump chamber 102 to the second pump chamber 106, at which point the evacuated material is discharged into the compression chamber 38 via the second pump outlet 110. In the illustrated embodiment, the second pump outlet 110 includes a valve (e.g., a reed valve, etc.) that selectively releases the evacuated material into the compression chamber 38 before being released from the vacuum pump 10 through the exhaust (e.g., via the cap 66) of the compression chamber 38.

With continued reference to FIGS. 6 and 7, the first and second rotors 114, 116 are eccentrically mounted within the first and second pump chambers 102, 106, respectively. Specifically, the first rotor 114 is smaller in diameter relative to the first pump chamber 102 and positioned such that an outer surface 128 of the first rotor 114 is approximately tangent to the interior surface 124 of the first pump chamber 102 adjacent the first pump inlet 104. Similarly, the second rotor 116 is smaller in diameter relative to the second pump chamber 106 and positioned such that an outer surface 132 of the second rotor 116 is approximately tangent to the interior surface 124 of the second pump chamber 106 adjacent the second pump inlet 108. As explained in further detail below, it is important for the first and second rotors 114, 116 to be approximately tangent to the first and second pump chambers 102, 106 to ensure a proper seal within the pump assembly 42.

To provide some background, if either of the rotors 114, 116 are spaced too far away from the interior surface 124 of the pump chambers 102, 106, then the pump assembly 42 fails to make a low-pressure zone because a proper seal cannot be made between the first pump inlet 104 and the second pump outlet 110. Now, if either of the rotors 114, 116 are spaced too close to the interior surface 124 of the pump chambers 102, 106, then excessive frictional forces are generated between the rotors 114, 116 and the pump chambers 102, 106 causing undue wear on the vacuum pump 10.

Returning to FIGS. 6 and 7, the first pump chamber 102 includes a first seal 136 that is disposed between the first pump inlet 104 and the first pump outlet 105 for creating a moveable seal with the first rotor 114. The first seal 136 is in continuous engagement with the first rotor 114 and moveable toward the first rotor 114 along a direction perpendicular to the drive axis 100. Also, the first seal 136 is in sliding contact with the first rotor 114 and the vanes 118 as the first rotor 114 rotates. A first spring 140 biases the first seal 136 toward the first rotor 114. As illustrated, the first seal 136 includes a wall section 144 that has a radius equal to a radius R of the first pump chamber 102, while the first rotor 114 includes a radius r that is less than the radius R of the first pump chamber 102. That said, the wall section 144 of the first seal 136 remains approximately tangentially engaged with the outer surface 128 of the first rotor 114.

Now, the second pump chamber 106 also includes a seal (i.e., a second seal 148) that is disposed between the second pump inlet 108 and the second pump outlet 110 for creating a moveable seal with the second rotor 116. The second seal 148 is in continuous engagement with the second rotor 116 and moveable toward the second rotor 116 along a direction perpendicular to the drive axis 100. Also, the second seal 148 is in sliding contact with the second rotor 116 and the vanes 120 as the second rotor 116 rotates. A second spring 152 biases the second seal 148 toward the second rotor 116. As illustrated, the second seal 148 includes a wall section 156 that has a radius equal to the radius R of the second pump chamber 106, while the second rotor 116 includes the radius r that is less than the radius R of the second pump chamber 106. That said, the wall section 156 of the second seal 148 remains approximately tangentially engaged with the outer surface 132 of the second rotor 116. The spring stiffness of each spring 140, 152 is configured to apply a sufficient force on the first and second seals 136, 148 to create a proper seal within the first and second pump chambers 102, 106 while avoiding excessive friction forces being generated that may otherwise damage the vacuum pump 10. Although the first and second seals 136, 148 of the illustrated embodiments are composed of steel, in other embodiments, the first and second seals 136, 148 may be composed of a variety of other types of material, such as plastics, ceramics, or flexible elastomers.

Figure 8:
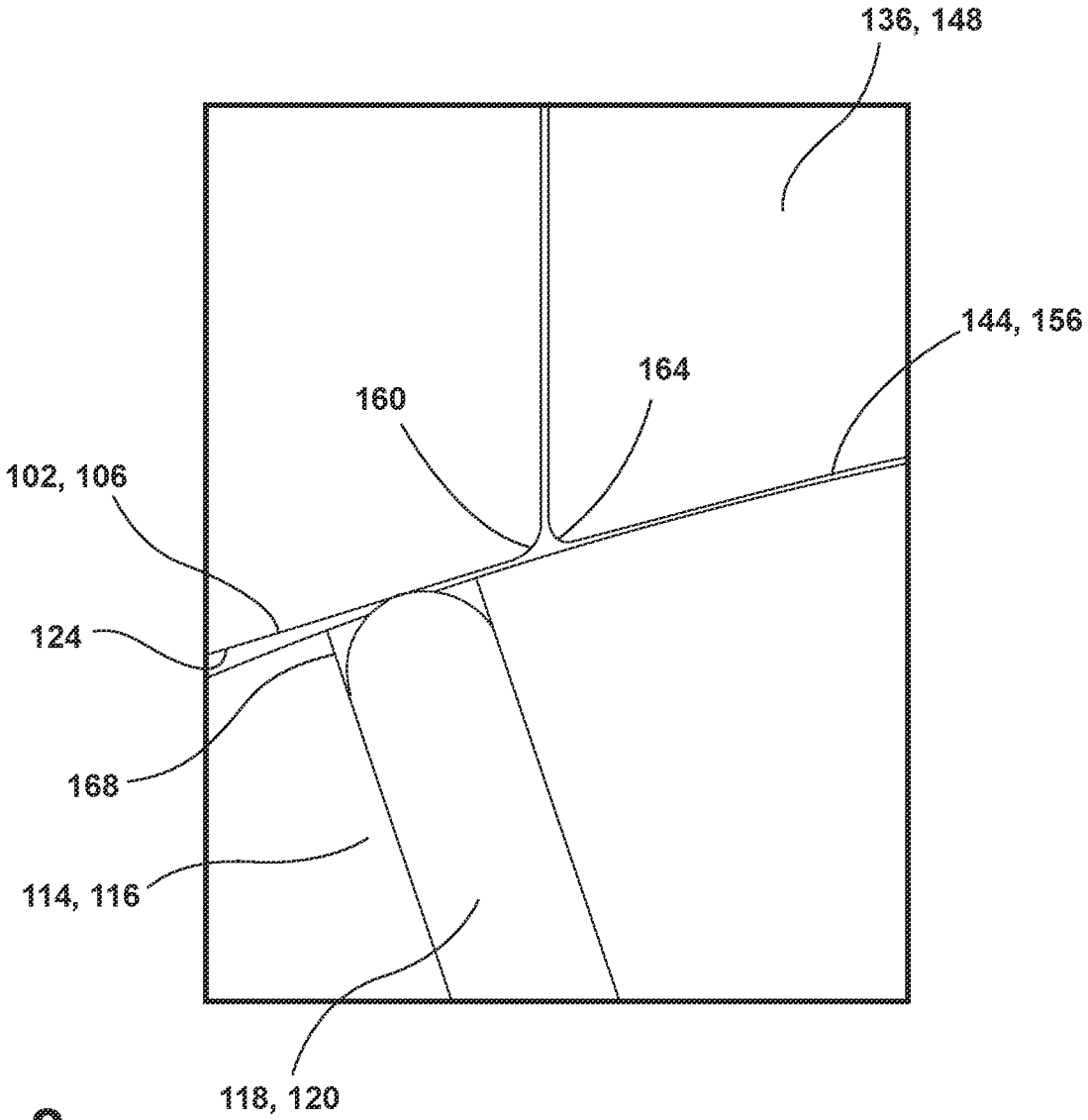
FIG. 8 is an enlarged view of the interface between the seal and a rotor of the pump assembly.

With reference to FIG. 8, the interior surface 124 of the first and second pump chambers 102, 106 include a fillet edge 160 that is adjacent another fillet edge 164 of the first and second seals 136, 148. The fillet edge 164 ensures that the first and second seals 136, 148 avoid catching a shoulder 168 of the first and second rotors 114, 116 adjacent the vanes 118, 120. The fillet edges 160, 164 also reduce wear on the vanes 118, 120 as the vanes 118, 120 slide from the interior surface 124 of the first and second pump chambers 102, 106 to the wall sections 144, 156 of the first and second seals 136, 148.

During operation, a user may attach the battery pack 50 to the battery receptacle 52 of the vacuum pump 10, and fluidly connect the external system 46 to the vacuum pump 10 via the inlet manifold 44 (e.g., with the hose 40). The user may activate the vacuum pump 10 with the control panel 54 (e.g., by depressing the power switch 56) to activate the motor assembly 30 and begin evacuating material from the external system 46. When the vacuum pump 10 is activated, the first and second rotors 114, 116 begin rotating within the first and second pump chambers 102, 106, which creates a low-pressure zone to evacuate material from the external system 46. As the first and second rotors 114, 116 rotate, the first and second seals 136, 148 are biased toward the first and second rotors 114, 116, respectively, and remain in continuous contact with the outer surface 128, 132 of the first and second rotors 114, 116. Also, the first and second seals 136, 148 remain in constant contact with the vanes 118, 120 as the vanes 118, 120 slide past the first and second seals 136, 148.

Various features of the invention are set forth in the following claims.

What is claimed is:

1. A vacuum pump that is connectable to an external system and configured to evacuate material from the external system, the vacuum pump comprising:

a housing including a motor housing, a pump housing, and a trestle that separates the motor housing and the pump housing;

a base coupled to a lower portion of the housing;

a motor assembly that is positioned within the motor housing;

a control panel disposed on a first sidewall of the housing;

a battery that is coupled to the motor housing and configured to supply electrical current to the motor assembly;

a pump assembly that is positioned within the pump housing, the pump housing is sealed relative to the motor housing to form a compression chamber storing a lubrication fluid, wherein the pump assembly is driven by the motor assembly and is in fluid communication with the compression chamber;

an inlet manifold coupled to the trestle and configured to fluidly connect the pump assembly to the external system; and a bumper composed of an elastomeric material and coupled to the trestle on a second sidewall of the housing that is opposite the first sidewall, the bumper is configured to protect the vacuum pump from damage when inadvertently dropped, and wherein the first sidewall and the second sidewall extend upward from the base.

2. The vacuum pump of claim 1, further comprising an O-ring that is disposed on an outer periphery of the inlet manifold such that the inlet manifold is sealingly coupled to the trestle.

3. The vacuum pump of claim 1, wherein the inlet manifold is fastened to the trestle using a plurality of threaded fasteners that are received within corresponding threaded bores of the trestle.

4. The vacuum pump of claim 1, wherein the bumper includes a pair of T-ribs that are received within a pair of corresponding slots of the trestle, wherein the T-ribs retain the bumper to the trestle.

5. The vacuum pump of claim 4, wherein the bumper includes a concave face from which the T-ribs project, wherein the concave face deforms and lays flat against the trestle as the T-ribs are received in the slots.

* * * * *